US006213423B1

(12) United States Patent
St. Germain et al.

(10) Patent No.: US 6,213,423 B1
(45) Date of Patent: Apr. 10, 2001

(54) SELF-LIFTING SHAFTLESS UNWIND STAND

(75) Inventors: Patrick C. St. Germain, Iron River; Vernon C. Wickman, Port Wing, both of WI (US)

(73) Assignee: Specialty Systems Advanced Machinery, Inc., Iron River, WI (US)

( * ) Notice: Subject to any disclaimer, the term of this patent is extended or adjusted under 35 U.S.C. 154(b) by 0 days.

(21) Appl. No.: 09/325,091

(22) Filed: Jun. 3, 1999

(51) Int. Cl.[7] ..... B65H 19/00

(52) U.S. Cl. ..... 242/559.2; 242/559.1; 242/533.4; 242/533.5; 414/911

(58) Field of Search ..... 242/559.1, 559.2, 242/533.2, 533.4, 533.5, 563.2, 564.5; 414/911

(56) References Cited

U.S. PATENT DOCUMENTS 4,597,316 * 7/1986 Ichikawa ..... 242/559.2 X
4,893,763 * 1/1990 Wales et al. ..... 242/559.1 X
5,004,173 * 4/1991 Kawai ..... 242/559.1 X
5,192,033 3/1993 Pipes .
5,330,126 7/1994 Grischenko .
5,333,803 8/1994 Planeta .
5,657,944 8/1997 Kewin .

* cited by examiner

*Primary Examiner*—John Q. Nguyen
(74) *Attorney, Agent, or Firm*—Olson & Hierl, Ltd.

(57) ABSTRACT

A machine for lifting a roll of previously wound material and for unwinding the material from the roll is disclosed. The machine includes a turret shaft around which a lift arm assembly is moved from a first position to a second position. A lifting mechanism for lifting the roll after it is loaded at the first position is also provided. A plurality of lift arm assemblies can be provided so that a stand-by roll can be loaded onto the machine to be quickly rotated into an unwinding position. The lift arm assembly supports the roll without the use of a shaft through the core of the roll. A drive tower is provided which includes a turning belt with a frictional contact surface for contacting the roll as the turning belt is rotating, thereby turning the roll to unwind the material therefrom.

14 Claims, 8 Drawing Sheets

SELF-LIFTING SHAFTLESS UNWIND STAND

FIELD OF THE INVENTION

The present invention relates generally to a machine for unwinding material from a previously wound roll and, more particularly, to an improved machine onto which rolls of material can be loaded in preparation for unwinding and then quickly and easily rotated into an unwinding position when a previous roll has been unwound.

BACKGROUND OF THE INVENTION

Many products are manufactured from elongated sheet or stock material that is shipped and stored in the form of a roll or coil. Continuous strips or webs of thin, flexible material are commonly provided on storage rolls that are subsequently unwound for production of items made from these materials. Examples of these materials are plastic film, metal foil, and paper. Other materials such as cable or wire are also wound onto rolls.

During the manufacture of paper products such as napkins, newspapers, and magazines, for example, very large storage rolls of paper are used to provide the stock material from which the paper items are produced. The storage rolls are then unwound for further processing such as cutting, folding, or printing.

When a coiled roll is being unwound so that the material can be further processed, it is desirable to quickly change to a new roll once the previous roll is spent. However, the large and heavy storage rolls of stock material are difficult to handle. Also, the manufacturing process must be stopped so that the spent roll can be removed and replaced by a new roll. The time spent unloading and reloading the machine results in decreased production of the final product.

A machine that can accept subsequent or stand-by rolls of stock material that are ready to be moved quickly into an unwinding position is highly desirable because of the savings in time that such a machine would provide. The stand-by roll can be quickly moved into place, and the unwinding and subsequent processes can proceed with minimal interruption.

The placement of a roll of material onto a shaft or spindle which is then mounted onto a machine for unwinding of the roll is another time-consuming manufacturing step. The added steps of inserting the shaft into the core of the roll and then removing it when the roll is unwound result in additional time spent setting up the machine which also decreases production. A machine that can hold and unwind a roll of material without using a shaft or spindle would be advantageous.

Thus, there continues to be a need for a method and apparatus for unwinding material from a roll that allows the loading of subsequent rolls of material which are then quickly rotated into position for unwinding. Also, there is a need for a method and apparatus that will increase the speed of the unwinding process by eliminating time-consuming steps, thus increasing productivity. The present invention meets these desires.

SUMMARY OF THE INVENTION

A roll unwinding machine embodying the present invention performs lifting and turning operations on a roll of material in order to unwind the material from the roll.

The material on the roll may be a thin flexible web of material such as foil, plastic film, fabric, or paper.

Alternatively, the material may be an elongated strip or length of material such as, for example, wire, cable, string, or rope. For simplicity of explanation, references herein to paper as the material on the roll should be construed to include any material capable of being wound onto a roll and subsequently unwound.

The unwinding machine of the present invention comprises a base with a turret shaft extending vertically from the base. A turret bearing ring is coaxially and rotatably disposed around the turret shaft. In the preferred embodiment described herein, more than one turret bearing ring can be provided.

A lift arm assembly is provided for lifting and rotatably holding the roll of material. The lift arm assembly is pivotally connected to the turret bearing ring and is movable around the turret shaft in conjunction with the turret bearing ring. In the preferred embodiment described herein, the lift arm assembly moves between first and second positions around the turret shaft.

In the preferred embodiment, the loading and unwinding operations take place at first and second positions, respectively, around the turret shaft. The first and second positions, however, are interchangeable with respect to the operation performed at each position. The terms "first" and "second" are used for descriptive purposes herein in reference to the relative positions of the lift arm assembly as it rotates around the turret shaft.

More than one lift arm assembly may be provided in the preferred embodiment of the present invention. When additional lift arm assemblies are provided, a subsequent roll (or rolls) can be loaded onto the machine in advance of being unwound. While a roll is in the process of being unwound, a subsequent roll can be loaded onto the machine and held at a waiting position until the previous roll is fully unwound. The subsequent roll is then moved into the unwinding position after the core of the previously unwound roll is moved out of the unwinding position.

The lift arm assembly includes two generally parallel lift arms which accept and support the roll of material during loading and unwinding operations, respectively. Each lift arm of the lift arm assembly has a first end for supporting the roll and a pilot bearing at the first end. Each lift arm also includes a second end that is operably associated with a lift arm track. The lift arms are horizontally movable relative to each other along the lift arm track. In operation, the lift arms move away from each other to accept the roll during loading of the roll onto the machine. The lift arms then move toward each other to releasably and rotatably hold the roll between the pilot bearings. The lift arms support the roll during turning of the roll to unwind the material.

A guide cam is located around the turret shaft. The guide cam includes an outer rim around its periphery for supporting the lift arm assembly while the lift arm assembly moves around the turret shaft between first and second positions.

A support beam extends from the lift arm track toward the guide cam. The support beam has a distal end with a cam yoke roller at the distal end. The cam yoke roller cooperates with the outer rim to support the lift arm assembly during its movement around the turret shaft.

A lifting mechanism is provided in the preferred embodiment. The lifting mechanism is operably associated with the cam yoke roller to raise and lower the lift arm assembly between an up position and a down position. The roll is loaded onto the machine when the lift arm assembly is in the down position. The roll is then raised to the up position, moved around the turret shaft into the unwinding position and then unwound, as described below.

The preferred embodiment described herein further comprises a drive tower extending upwardly from the turret shaft. The drive tower includes the mechanism for turning the roll to unwind the material therefrom once it has been loaded and moved into the unwinding position. A tower frame, a turning belt, a drive for rotating the turning belt, a belt frame, a belt frame axle, an upper roller, and a lower roller are the components of the drive tower that are employed during the turning of the roll of material.

The tower frame has generally vertical first and second side walls, an upper portion, and a lower portion. The lower portion includes a bracket that extends between the first and second side walls and provides a mount for the tower frame to the turret shaft. The belt frame axle extends through the first and second side walls of the tower frame adjacent to the upper portion.

The belt frame includes a first member, a second member, a free end, and an axle end. The first and second members are located between the first and second sides of the tower frame. The axle end of the belt frame is pivotally attached to the belt frame axle, and the free end of the belt frame is adjacent to the lower portion of the tower frame. The free end of the belt frame is free to swing away from the tower frame as the belt frame pivots around the belt frame axle at the upper portion of the tower frame.

The upper and lower rollers are both disposed between the first and second members of the belt frame. The upper roller is coaxial with the belt frame axle, and the lower roller is adjacent to the free end of the belt frame.

The turning belt extends around the upper and lower rollers and has a contact surface for frictionally contacting the roll and driving the roll. The belt frame is pivoted at the belt frame axle such that the free end of the belt frame extends outwardly from the tower frame and toward the roll being held by the lift arm assembly. When the rotating turning belt contacts the roll, the roll is rotated, thereby unwinding the material therefrom.

In operation, the lift arm assembly is initially placed at the first position and a roll of material is placed between the lift arms which are moved apart to accept the roll. The lift arms are then moved toward each other to hold the roll between the pilot bearing on the lift arms. The roll is then lifted by the lift arm assembly which then moves to the second position where the roll will be unwound. The free end of the belt frame is then pivoted away from the drive tower and toward the roll until the turning belt contacts the roll. As the turning belt rotates, it frictionally turns the roll to unwind the roll. As the material on the roll is unwound, the diameter of the roll decreases, and the free end of the belt frame is further pivoted so as to keep the belt in continuous contact with the roll until unwinding is complete.

There are other advantages and features of the present invention which will be more readily apparent from the following detailed description of the preferred embodiment of the invention, the drawings, and the appended claims.

DESCRIPTION OF THE PREFERRED EMBODIMENTS

Figure 1:
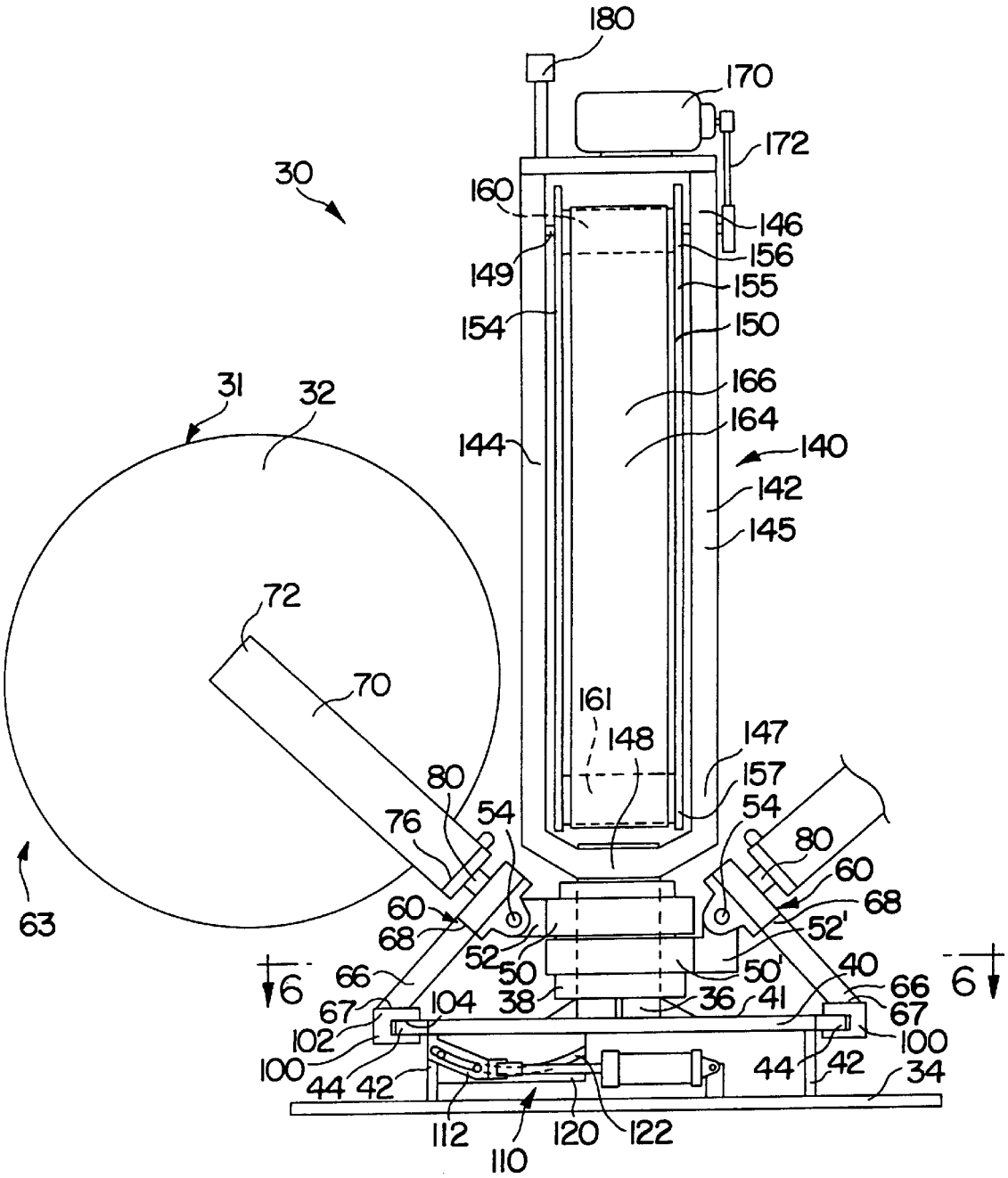
FIG. 1 is a front view of an unwinding machine embodying the present invention.

The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

For ease of description, a machine embodying the present invention is described hereinbelow in its usual assembled position as shown in the accompanying drawings and terms such as upper, lower, horizontal, longitudinal, etc., may be used herein with reference to this usual position. However, the machine may be manufactured, transported, sold, or used in orientations other than that described and shown herein.

Referring to FIGS. 1–8, an unwinding machine 30 embodying the present invention provides a self-lifting, driven, shaftless unwind stand for lifting, moving, and unwinding a roll 31 of previously wound material 32. The roll 31 can include a hollow, cylindrical core 33 around which the material 32 is wound.

Figure 2:
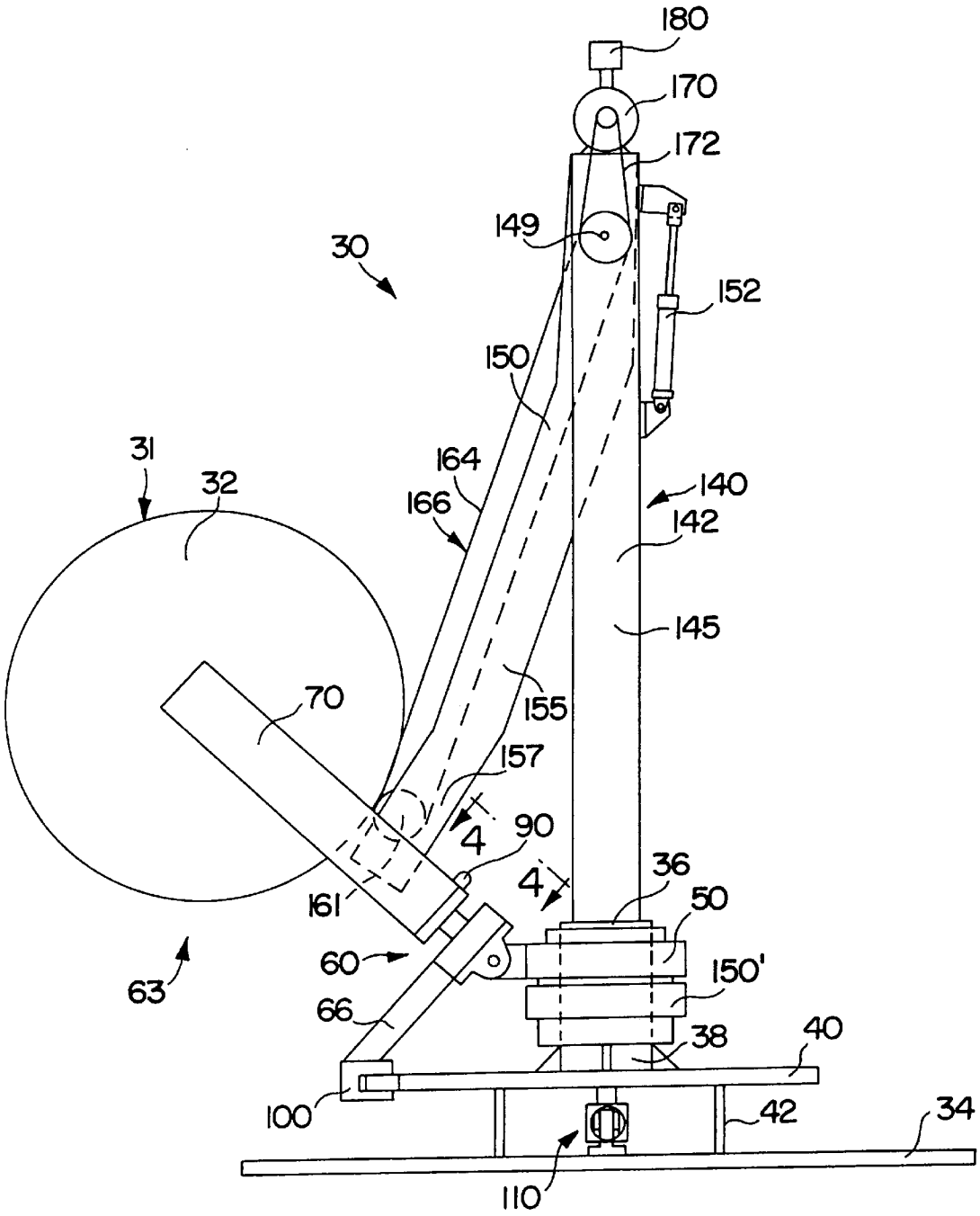
FIG. 2 is a side view of the unwinding machine showing a roll of material being turned to unwind the material therefrom.

The unwinding machine 30 of the present invention preferably comprises a generally flat, horizontal base 34 with a cylindrical turret shaft 36 extending upwardly from the base 34. As shown in FIGS. 1 and 2, the machine 30 also includes a guide cam 40, described in detail below, mounted on a plurality of supports 42 above and generally parallel to the base 34. The turret shaft 36 of the preferred embodiment is mounted to the top 41 of the guide cam 40 and extends vertically therefrom.

A turret bearing ring 50 is coaxially and rotatably disposed around the turret shaft 36. The turret bearing ring 50 is generally cylindrical with a protrusion 52 radially extending from the turret bearing ring 50. The protrusion 52 is provided so that a lift arm assembly 60, described in detail below, can be connected or mounted to the turret bearing ring 50 at a mounting point 54 on the protrusion 52. Preferably, the mounting point 54 is adapted to provide a pivot point for the lift arm assembly 60.

The turret bearing ring 50 rests on a collar 38 at the bottom of the turret shaft 36. The collar 38 is preferably coaxial with and fixedly attached to the turret shaft 36 and has an outer diameter larger than the inner diameter of the turret bearing ring 50 which rests on top of the collar 38.

The turret bearing ring 50 can include any type of suitable bearing configuration known in the art which allows relatively free rotation of the turret bearing ring 50 around the turret shaft 36.

A drive system of any suitable type known in the art can be employed to rotate the turret bearing ring 50. For example, the turret bearing ring 50 can be rotated by a belt or chain 53 operably connected to a drive such as a motor 55, shown schematically in FIG. 3. Alternatively, a suitable gear system can be configured to rotate the turret bearing ring 50.

In the preferred embodiment described herein and as shown in FIGS. 1 and 2, more than one turret bearing ring 50 can be provided. In such a case, the turret bearing rings 50, 50' are stacked on the turret shaft 36, and the protrusions 52 are configured such that the mounting points 54 of each turret bearing ring 50 are at substantially the same vertical height with respect to the guide cam 40. For example, protrusion 52' extends radially and upwardly because the turret bearing ring 50' from which it extends is the lower of the two turret bearing rings in the embodiment shown in FIGS. 1 and 2.

Figure 7:
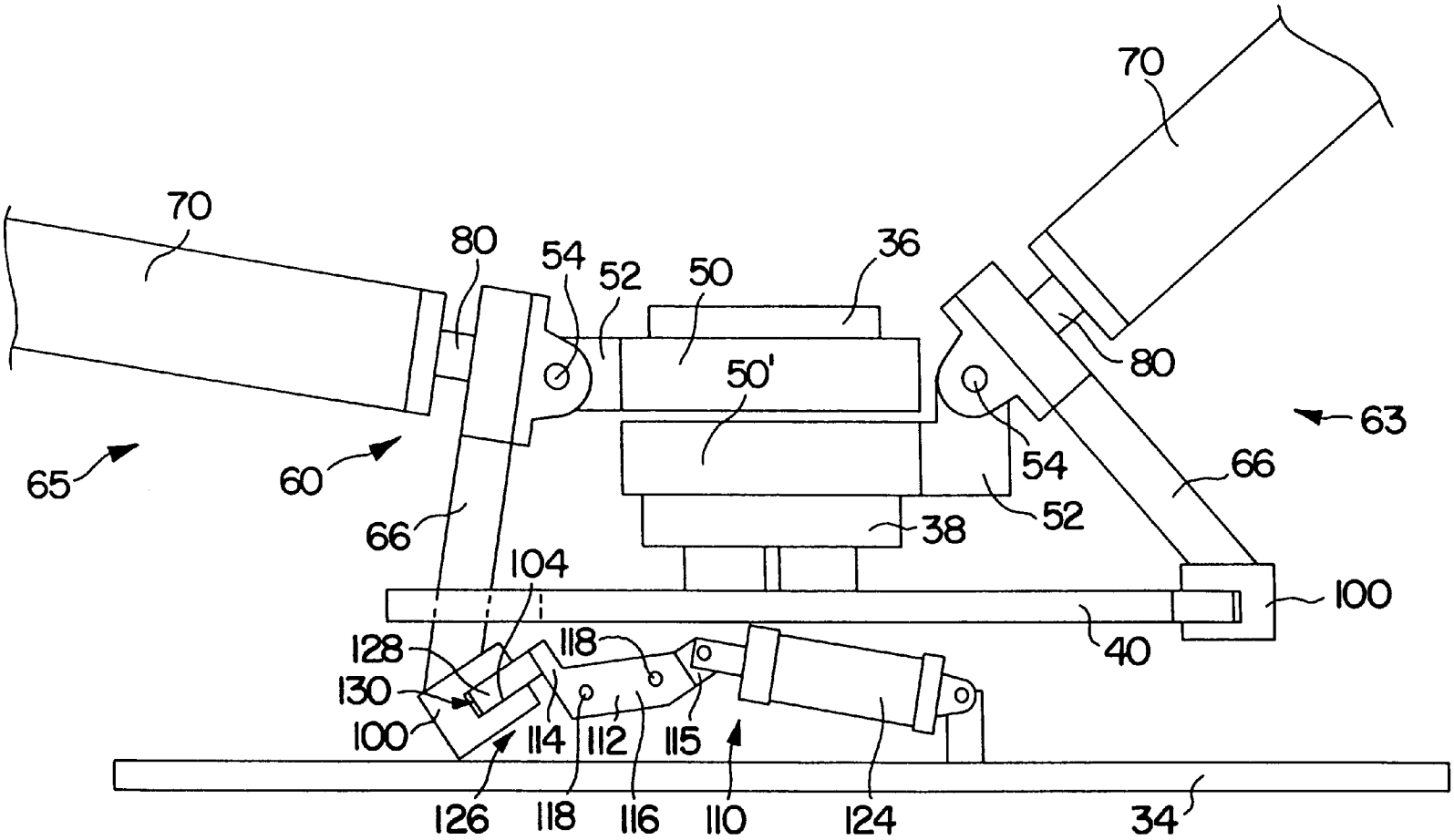
FIG. 7 is an enlarged partial view of the unwinding machine showing a lifting mechanism of the unwinding machine with the lift arm assembly in a down position.

The lift arm assembly 60 is provided for lifting and rotatably holding the roll 31 of material. In the preferred embodiment, the lift arm assembly 60 is pivotally connected to the turret bearing ring 50 such that the lift arm assembly 60 is pivotable between an up position 63 (FIGS. 1, 2 and 8) and a down position 65 (FIG. 7). Also, the lift arm assembly 60 preferably is movable around the turret shaft 36 in conjunction with the turret bearing ring 50, i.e. when the turret bearing ring 50 rotates around the turret shaft 36, the lift arm assembly 60 moves circumferentially around the turret shaft 36.

Figure 3:
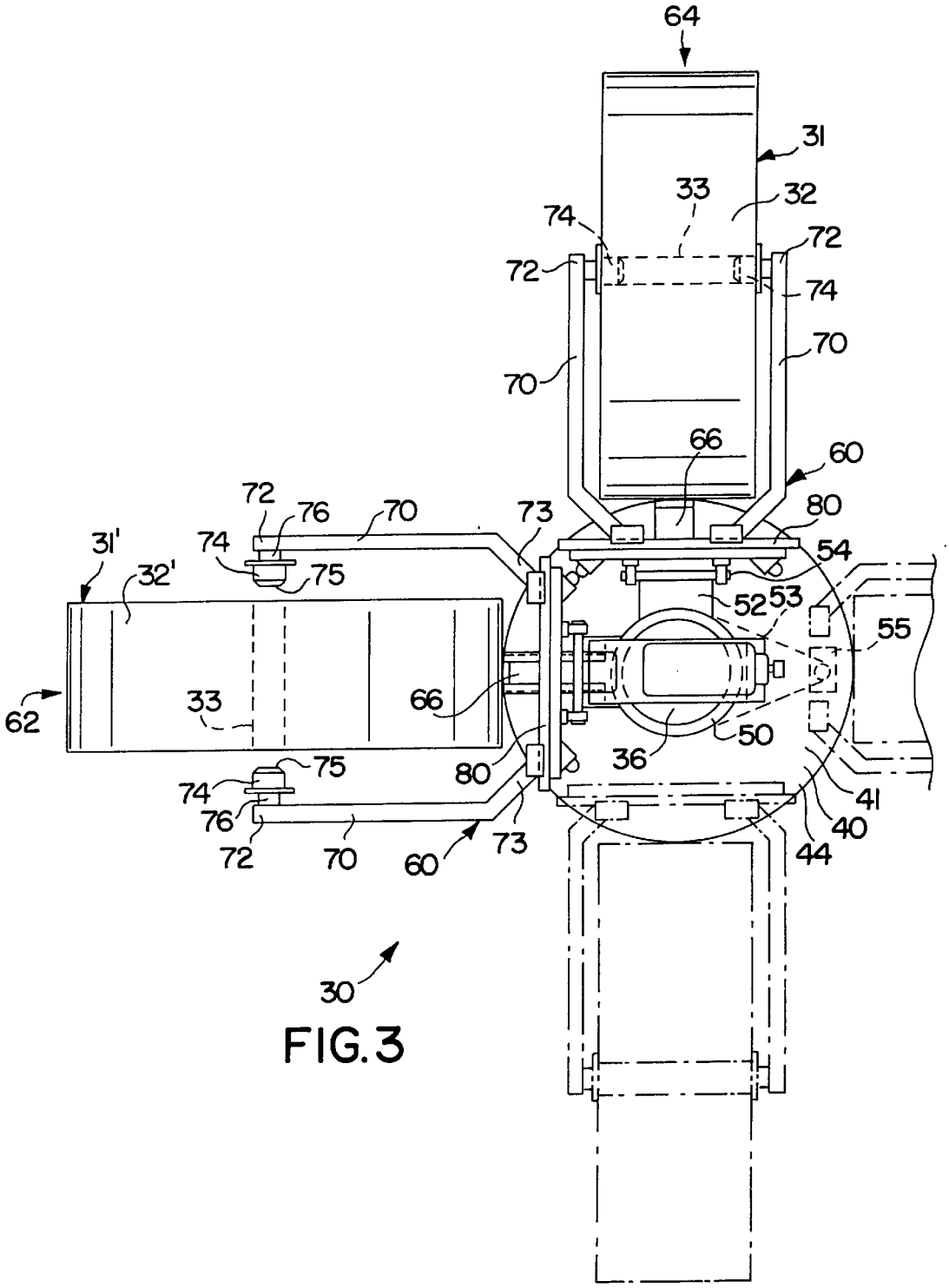
FIG. 3 is a top plan view of the unwinding machine showing a roll being loaded onto the machine and a roll at the unwinding position.

Referring to FIG. 3, the lift arm assembly 60 moves between a first position 62 and a second position 64 around the turret shaft 36. In the preferred embodiment, the first and second positions are about 90 degrees apart circumferentially around the turret shaft 36. The relative locations around the turret shaft 36 of the first and second positions, however, can be selected as desired, limited only by the width of the lift arm assembly 60.

Alternatively, additional positions can be provided around the turret shaft 36, as illustrated in FIG. 3. For example, two additional positions for the lift arm assembly 60 can be provided. In the example of FIG. 3, two lift arm assemblies 60 can be moved between four positions around the turret shaft 36. The four positions are each about 90 degrees from adjacent positions. Alternatively, four lift arm assemblies 60 can be provided on the machine 30.

When additional lift arm assemblies 60 are provided, a subsequent roll 31' (or rolls) can be loaded onto the machine and held at a waiting position until the previous roll 31 is fully unwound; The subsequent roll 31' is then moved into the unwinding position 64 after the previously unwound roll 31 has been moved out of the unwinding position 64.

In the preferred embodiment as exemplified in FIG. 3, the loading and unwinding operations take place at the first and second positions, 62 and 64, respectively. The first and second positions, however, are interchangeable with respect to the operation performed at each position. The terms "first" and "second" are used for descriptive purposes herein in reference to the relative positions of the lift arm assembly 60 as it moves around the turret shaft 36.

Referring to FIGS. 1–5, the lift arm assembly 60 includes two generally parallel lift arms 70 which accept and support the roll 31 of material during loading and unwinding operations, respectively. Each lift arm 70 has a first end 72 for supporting the roll 31 and a second end 73 operably associated with a lift arm track 80. The lift arms 70 are horizontally movable relative to each other along the lift arm track 80, as described in further detail below.

Referring again to FIG. 3, the first end 72 of each lift arm 70 includes a pilot bearing 74. Each pilot bearing 74 is preferably cylindrical with a tapered leading end 75 and is freely rotatable around a pilot bearing axle 76. Each pilot bearing axle 76 is substantially perpendicular to its respective lift arm 70. Rotary bearings or any other mechanism known in the art can be used to provide relatively frictionless and free rotation of the pilot bearings 74.

The pilot bearings 74 are located on each lift arm 70 directly across from each other so as to be substantially coaxial. The pilot bearings 74 are adapted to fit into the hollow core 33 of the roll 31 thereby supporting the roll 31 at both ends of the hollow core 33 without the use of a shaft.

Figure 4:
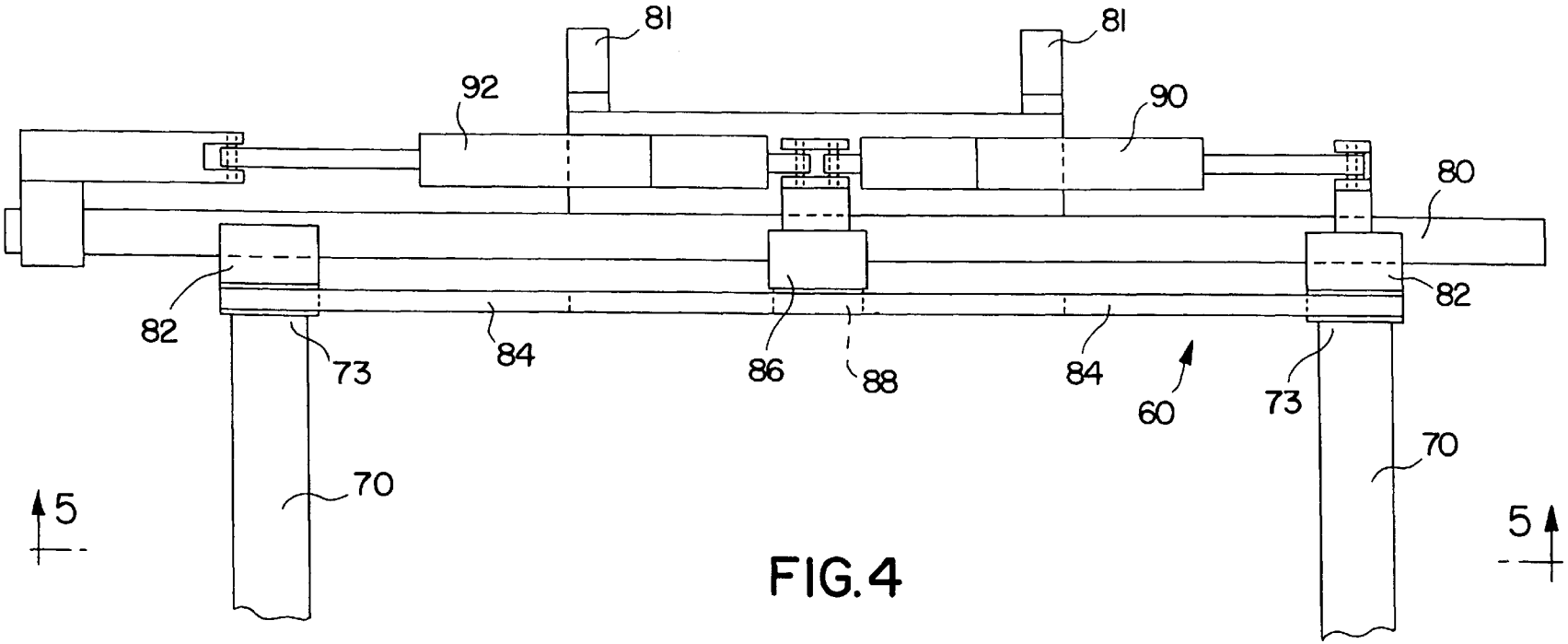
FIG. 4 is a partial top plan view of a lift arm assembly of the unwinding machine of FIG. 2 taken along line 4—4 of FIG. 2.
Figure 5:
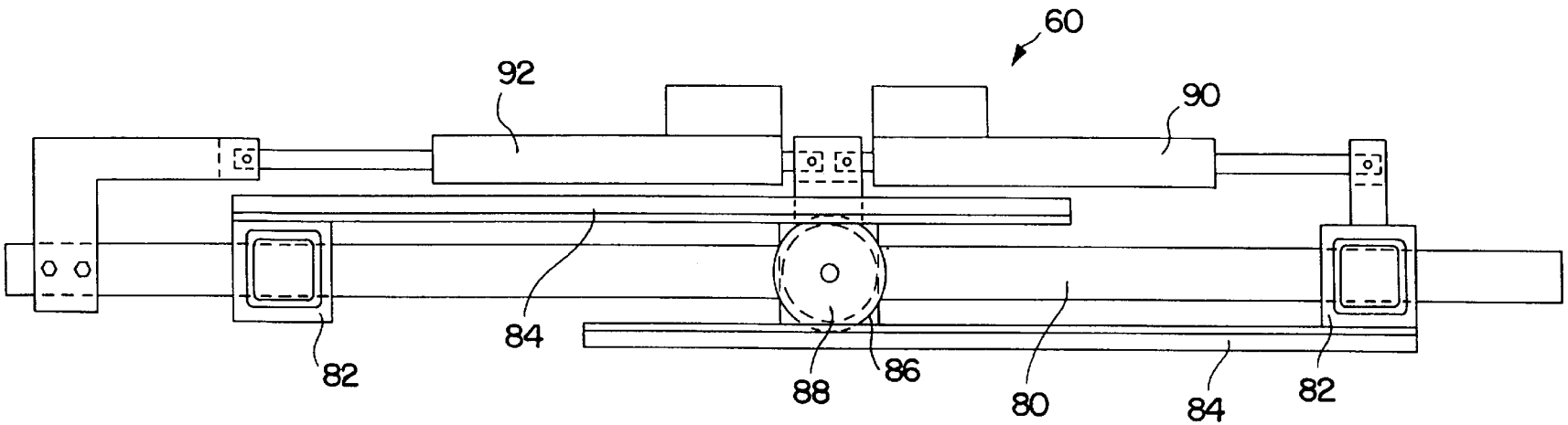
FIG. 5 is a front view of the lift arm assembly of FIG. 4 taken along line 5—5 of FIG. 4.

The second end 73 of each lift arm 70 is slidably mounted onto the lift arm track 80, as shown in FIGS. 4 and 5. Preferably, the lift arm track 80 is an elongated beam that is disposed generally horizontally with respect to the turret shaft 36. In the embodiment illustrated in FIG. 4, the lift arm track 80 includes two protruding mounting ears 81 for connecting to the protrusion 52 on the turret bearing ring 50.

A lift arm linear bearing 82 is disposed at the second end 73 of each lift arm 70. The lift arm linear bearing 82 is engaged with and slides along the lift arm track 80 to provide the horizontal movement of the lift arms 70. Each lift arm linear bearing 82 is attached to a rack gear 84 that extends toward the opposite lift arm 70. The rack gears 84 are generally perpendicular to the lift arms 70 and parallel to the lift arm track 80 and each other.

A pinion gear linear bearing 86 is mounted to the lift arm track 80, preferably between the lift arm linear bearings 82. A pinion gear 88 is rotatably mounted to the pinion gear linear bearing 86. The rack gears 84 are spaced apart from each other, and the pinion gear 88 is located between the rack gears 84 and engaged with both rack gears 84 simultaneously.

The motion of the lift arms 70 toward and away from one another is controlled by a roll clamp actuator 90 which is mounted to the pinion gear linear bearing 86 and one of the lift arm linear bearings 82. The roll clamp actuator 90 of the preferred embodiment is an extendable and retractable piston. Alternatively, the roll clamp actuator 90 can comprise any mechanism that is capable of transmitting linear force.

The roll clamp actuator 90 moves the lift arm linear bearing 82 to which it is mounted and the pinion gear linear bearing 86 laterally relative to each other along the lift arm track 80. As the lift arm linear bearing 86, and thus the rack gear 84 to which it is attached, moves, the rack gear 84 rotates the pinion gear 86, which in turn moves the other rack gear 84 in the opposite direction. The rack and pinion system provides for equidistant horizontal movement of the lift arms 70.

A web tracking actuator 92 is provided which is also preferably embodied in an extendable and retractable piston. As shown in FIG. 5, one end of the web tracking actuator 92 is attached to the end of the lift arm track 80, and the other end of the web tracking actuator 92 is attached to the pinion gear linear bearing 86. Motion of the web tracking actuator moves both lift arms 70 simultaneously in either direction along the lift arm track 80. This movement can be used to position the roll 31 of material 32 to the proper location with respect to the drive tower for unwinding.

In operation, the lift arms 70 are moved away from each other for roll loading and removal by extending the roll clamp actuator 90. The lift arms 70 are moved toward each other to rotatably hold the roll 31 between the pilot bearings 76 by retracting the roll clamp actuator 90. Preferably, and as illustrated in FIG. 3, the pilot bearings 76 are at least partially inserted into the roll core 33 when the lift arms 70 are moved toward each other. Thus, the lift arms 70 support the roll 31 during turning of the roll 31 to unwind the material.

Alternatively, the pilot bearings 76 can be pressed against the side of the roll 31 to hold and support the roll 31. While the pilot bearings 76 are provided for supporting the roll 31 without a shaft or spindle, another alternate embodiment of the machine 30 includes lift arms 70 configured for use with a shaft or spindle inserted into the core 33. The first ends 72 of the lift arms 70 can alternatively be adapted to accept the shaft and support the roll 31 by the shaft during unwinding.

Referring again to FIG. 3, once the roll 31 is clamped between the pilot bearings 76 at the loading position, the lift arm assembly 60 is moved in conjunction with its corresponding turret bearing ring 50 around the turret shaft 36 to the second or unwinding position 64. Once a roll 31 is loaded and held by the lift arms 70, the lift arm assembly 60 is supported by the guide cam 40 as shown in FIGS. 1 and 2.

Figure 6:
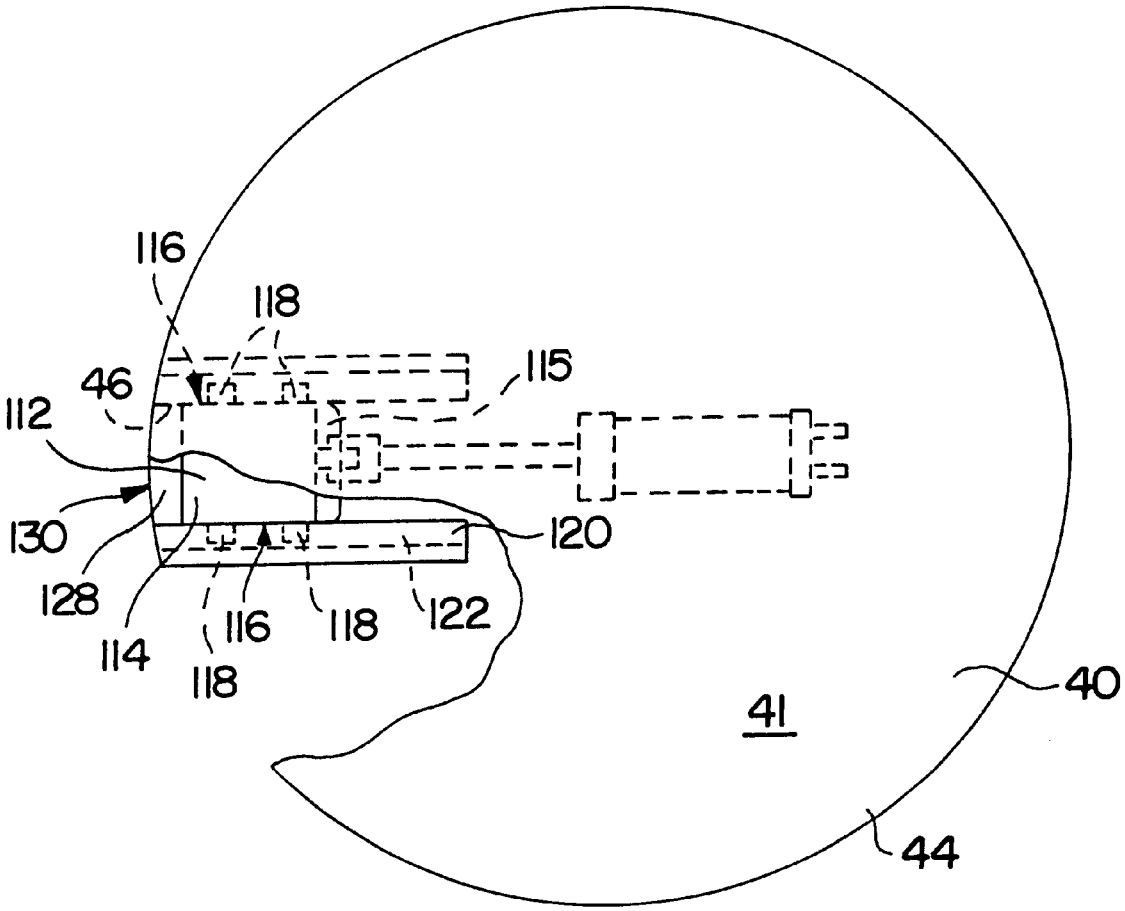
FIG. 6 is a partial cutaway, top plan view of a guide cam of the unwinding machine of FIG. 1 taken along line 6—6 of FIG. 1.

As shown in FIG. 6, the guide cam 40 of the preferred embodiment is a generally flat, horizontally disposed disk and is located around the turret shaft 36 below the turret bearing rings 50. The guide cam 40 includes an outer rim 44 around its periphery for supporting the lift arm assembly 60 while the lift arm assembly 60 moves around the turret shaft 36 between the first and second positions, 62 and 64. The outer rim 44 of the guide cam 40 is continuous except for a generally rectangular cutout 46 defined by the outer rim 44 corresponding to the first or loading position 62 in the preferred embodiment.

Referring again to FIGS. 1–3, the lift arm assembly 60 is supported at the outer rim 44 of the guide cam 40. Preferably, a support beam 66 extends from the lift arm track 80 toward the outer rim 44 of the guide cam 40. The support beam 66 has a distal end 67 that is operably associated with the outer rim 44 and a proximal end 68 that is connected to the lift arm assembly 60, preferably at the lift arm track 80.

A cam yoke roller 100 is mounted to the distal end 67 of the support beam 66. The cam yoke roller 100 cooperates with the outer rim 44 to support the lift arm assembly 60 during its movement around the turret shaft 36.

The cam yoke roller 100 comprises a block 102 defining a groove 104 therein. The cam yoke roller 100 is slidably mounted on the outer rim 44 of the guide cam 40 with the outer rim 44 positioned within the groove 104 when the lift arm assembly 60 is in the up position 63, as illustrated in FIGS. 1 and 2. In this manner, the cam yoke roller 100 slides along the circumference of the outer rim 44 of the guide cam 100. Alternatively, the cam yoke roller 100 can include any suitable type of bearing configuration for providing rolling contact between the cam yoke roller 100 and the guide cam 40. The term "slidably" is to be understood to include rolling contact.

Figure 8:
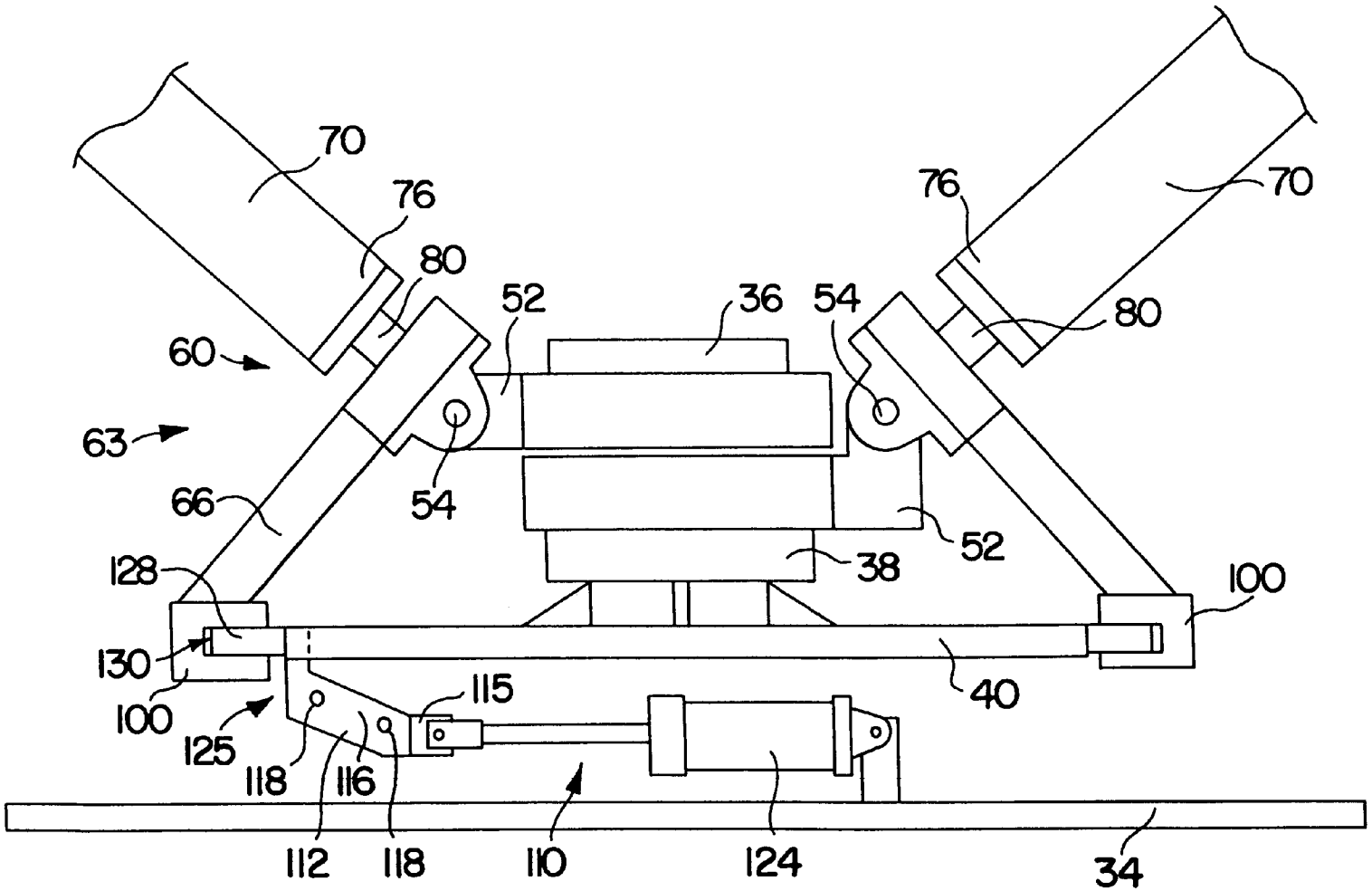
FIG. 8 is an enlarged partial view of the unwinding machine showing a lifting mechanism of the unwinding machine with the lift arm assembly in an up position.

Referring to FIGS. 1, 7, and 8, a lifting mechanism 110 is associated with the cam yoke roller 100 for pivoting the lift arm assembly 60 by moving the cam yoke roller 100 along an arc, the center point of which corresponds to the mounting point 54 of the lift arm assembly 60 on protrusion 52 of the turret bearing ring 50 and the radius of which is the distance between the mounting point 54 and the cam yoke roller 100. FIGS. 1 and 7 show the lifting mechanism 110 with the lift arm assembly 60 in the down position 65, and FIG. 8 shows the lifting mechanism 110 with the lift arm assembly 60 in the up position 63.

In the preferred embodiment as exemplified in FIGS. 6–8, the lifting mechanism 110 includes a lift truck 112 that engages the cam yoke roller 100 to move the lift arm assembly 60 between the up and down positions. The lift truck includes a front end 114, a back end 115, two side surfaces 116, and guide pins 118 protruding from the side surfaces 116.

The lift truck 112 is operably associated with a guide track 120 (shown in FIG. 6) which defines a curved groove 122 that corresponds to the arc having its center point at the mounting point 54 and its radius from mounting point 54 to cam yoke roller 100. The guide pins 118 protrude into the groove 122 and thereby guide the lift truck 112 as it moves the lift arm assembly 60 between the up and down positions.

A lifting cylinder 124 connected to the back end 115 of the lift truck 112 provides the force to move the lift truck 112 between an engaged position 125 (shown in FIG. 8) and a disengaged position 126 (shown in FIG. 7). The engaged position 125 corresponds to the up position 63 of the lift arm assembly 60, and the disengaged position 126 corresponds to the down position 65. The lifting cylinder 124 is preferably hydraulic or pneumatic, but can be any type of force transmitting device known in the art.

The lift truck 112 further includes a cam section 128 extending from the front end 114. The cam section 128 is configured to engage the guide cam 40 by fitting within the cutout 46 when the lift truck 112 is in the engaged position 125. The cam section 128 has an outer edge 130 that has a curvature matching that of the curvature of the outer rim 44 of the guide cam 40. Thus, the curvature of the outer rim 44 is continued along the outer edge 130 of the cam section 128 when the lift truck is in the engaged position 125.

In operation, when the lift arm assembly 60 moves to one of the first and second positions, which corresponds to the loading position, the lift truck 112 is in the engaged position 125 with the cam section 128 interposed in the cutout 46. Once the lift arm assembly 60 is moved into the loading (or first) position 62, the cam section 128 is positioned within the groove 104 of the cam yoke roller 100. The lifting cylinder 124 then retracts to pull the lift truck 112 from the engaged position 126 to the disengaged position 125. Thus, the cam yoke roller 100 moves together with the lift truck 112 to pivot the lift arm assembly 60 to the down position 65.

At this point or prior thereto, the lift arms 70 are moved apart as described above to allow a roll 31 to be placed between the lift arms 70 with the core 33 of the roll 31 aligned with the pilot bearings 74. Once the roll 31 is positioned between the pilot bearings 74, the lift arms 70 are moved toward each other until the pilot bearings 74 are engaged in the core 33 on each side of the roll 31.

The lift truck 112 is then moved back to the engaged position 125 (FIG. 8), thereby lifting the lift arm assembly 60 with the roll 31. Once the lift truck 112 is returned to the engaged position 125 and the cam section 128 is interposed in the cutout 46 (and thus horizontally aligned with the guide cam), the lift arm assembly 60 is moved to the second (or unwinding) position 64. The roll 31 is then in position to be unwound.

Referring again to FIGS. 1 and 2, the unwinding operation is accomplished in the preferred embodiment described herein by a drive tower 140 which extends upwardly from the turret shaft 36.

The drive tower 140 includes an upwardly extending tower frame 142. The tower frame 142 has generally vertical first and second side walls, 144 and 145. The first and second side walls, 144 and 145, are preferably elongated, generally rectangular members that provide sufficient structural support for the drive tower 140.

The tower frame 142 further includes an upper portion 146 and a lower portion 147. The lower portion 147 includes a bracket 148 that extends between the first and second side walls, 144 and 145. The bracket 148 provides the mount for the tower frame 140 to the turret shaft 36.

A belt frame axle 149 extends through the first and second side walls, 144 and 145, of the tower frame 142 adjacent to the upper portion 144. In the preferred embodiment, the belt frame axle 149 can extend only partially through the side walls of the tower frame 142.

The drive tower 140 further includes a belt frame 150 between the first and second side walls, 144 and 145. The belt frame 150 includes a first member 154, a second member 155, an axle end 156, and a free end 157. The first and second members, 154 and 155, are located adjacent to and between the first and second sides, 144 and 145, respectively, of the tower frame 142. The axle end 156 is pivotally attached to the belt frame axle 149. The free end 157 is adjacent the lower portion 147 of the tower frame 142 when the drive tower 140 is not unwinding a roll 31. The free end 157 of the belt frame 150 is free to swing away from the tower frame 142 because the belt frame 150 pivots around the belt frame axle 149 at the upper portion 146 of the tower frame 142.

In the preferred embodiment as illustrated in FIG. 2, a belt frame cylinder 152 is provided on the drive tower 140 to pivot the free end 157 of the belt frame 150 outwardly toward the roll 31 during the unwinding operation. Alternatively, any known mechanism for pivoting the belt frame 150 can be used.

An upper roller 160 and a lower roller 161 are both disposed between the first and second members, 154 and 155, of the belt frame 150. The upper roller 160 is coaxial with the belt frame axle 149, and the lower roller 161 is adjacent to the free end 157 of the belt frame 150.

A turning belt 164 extends around the upper and lower rollers, 160 and 161, and has a contact surface 166 for frictionally contacting the roll 31 and driving the roll 31. During the unwinding operation, the belt frame 150 is pivoted at the belt frame axle 149 such that the free end 157 of the belt frame 150 extends outwardly from the tower frame 142 and toward the roll 31 being held by the lift arm assembly 60 in the up position 63.

A turning belt drive 170 provides the rotation of the turning belt 164. The turning belt drive 170 preferably is a motor mounted to the upper portion 146 of the tower frame 142 and is connected to the belt frame axle 149 by a drive belt 172. The turning belt drive motor turns the belt frame axle 149, which in turn turns the upper roller 160, thus rotating the turning belt 164. When the contact surface 166 of the rotating turning belt 164 contacts the roll 31, the roll 31 is rotated, thereby unwinding the material therefrom. Alternatively, the belt drive can be operably associated with either the upper roller 160 or the lower roller 161.

A roll indicator 180 can be provided to indicate an amount of material on a roll 31 being unwound, i.e., to signal that a roll 31 has been unwound or is nearly fully unwound. The roil indicator 180, if provided, is preferably a lamp mounted to the upper portion of the tower frame 142 and is operably associated with a sensor that monitors the amount of material on the roll. Alternatively, the roll indicator 180 can be remotely located and can be an audible signal, or any type of signaling system known in the art.

The foregoing description and the accompanying drawings are illustrative of the present invention. Still other variations and arrangements of parts are possible without departing from the spirit and scope of this invention.

We claim:

1. A machine for moving a roll of material from a first position to a second position, the machine comprising:

a generally horizontal base;

a turret shaft extending upwardly from the base;

a turret bearing ring coaxially and rotatably disposed around the turret shaft;

a lift arm assembly connected to the turret bearing ring and movable around the turret shaft between a first position and a second position in conjunction with the turret bearing ring;

the lift arm assembly including a lift arm track connected to the turret bearing ring;

the lift arm assembly further including two generally parallel lift arms, each lift arm having a first end with a pilot bearing thereon for supporting the roll, each lift arm having a second end operably associated with the lift arm track, the lift arms being adapted to be horizontally movable relative to each other along the lift arm track, whereby the lift arms move away from each other to accept the roll and toward each other to releasably and rotatably hold the roll between the pilot bearings;

a horizontal guide cam located around the turret shaft and having an outer rim for supporting the lift arm assembly while the lift arm assembly moves between the first position and the second position;

a support beam extending from the lift arm track toward the guide cam, the support beam having a distal end; and a cam yoke roller at the distal end of the support beam, the cam yoke roller cooperating with the outer rim to support the lift arm assembly during movement of the lift arm assembly around the turret shaft.

2. The machine of claim 1 further comprising a drive tower extending upwardly from the turret shaft for turning the roll to unwind material therefrom;

the drive tower including a tower frame, a turning belt, a drive or rotating the turning belt, a belt frame, a belt frame axle, an upper roller, and a lower roller;

the tower frame having a generally vertical first side wall, a generally vertical second side wall, an upper portion, and a lower portion, the lower portion including a bracket extending between the first and second side walls and mounted to the turret shaft, the belt frame axle extending through the first and second side walls of the tower frame adjacent to the upper portion;

the belt frame including a first member, a second member, a free end, and an axle end, the first and second members being located between the first and second side walls of the tower frame, the axle end of the belt frame pivotally attached to the belt frame axle, and the free end of the belt frame being adjacent to the lower portion of the tower frame;

the upper roller and the lower roller being disposed between the first and second members of the belt frame, the upper roller being coaxial with the belt frame axle and the lower roller being adjacent to the free end of the belt frame; and the turning belt extending around the upper and lower rollers and having a contact surface for frictionally contacting the roll and driving the roll, the belt frame being pivoted at the belt frame axle such that the free end of the belt frame extends outwardly from the tower frame and toward the roll being held by the lift arm assembly, whereby when the turning belt contacts the roll, the roll is turned to unwind material therefrom.

3. The machine of claim 2 wherein the drive comprises a motor operably associated with one of the upper and lower rollers for driving the turning belt.

4. The machine of claim 2 further comprising a roll indicator associated with the drive tower for indicating an amount of material on the roll.

5. The machine of claim 1 wherein the lift arm assembly is pivotally connected to the turret bearing ring and is pivotable between an up position and a down position.

6. The machine of claim 5 wherein the cam yoke roller comprises a block defining a groove therein, the cam yoke roller being slidably mounted on the outer rim of the guide cam with the outer rim positioned within the groove when the lift arm assembly is in the up position.

7. The machine of claim 6 further comprising a lifting mechanism associated with the cam yoke roller for pivoting the lift arm assembly by moving the cam yoke roller;

the outer rim of the guide cam defining a curvature, and the guide cam defining a cutout at the outer rim of the guide cam corresponding to one of said first and second positions of the lift arm assembly;

the lifting mechanism including a lift truck having a front end and a back end, a lifting cylinder connected to the back end of the lift truck for moving the lift truck between an engaged position and a disengaged position, a guide track operably associated with the lift truck for guiding the lift truck as the lift truck moves between the engaged and disengaged positions, a cam section extending from the front end of the lift truck, the cam section configured to engage the guide cam by fitting within the cutout when the lift truck is in the engaged position, the cam section further having an outer edge with a curvature such that the curvature of the outer rim of the guide cam is continued along the outer edge of the cam section; and wherein when the lift arm assembly moves to one of said first and second positions, the cam section is positioned within the groove of the cam yoke roller, whereby the cam yoke roller moves together with the lift truck to pivot the lift arm assembly between said up and down positions.

8. A machine for moving a roll of material from a first position to a second position, the machine comprising:

a generally horizontal base;

a turret shaft extending upwardly from the base;

a turret bearing ring coaxially and rotatably disposed around the turret shaft;

a lift arm assembly pivotally connected to the turret bearing ring such that the lift arm assembly is pivotable between an up position and a down position and movable around the turret shaft between a first position and a second position in conjunction with the turret bearing ring;

the lift arm assembly including a lift arm track pivotally connected to the turret bearing ring and further including two generally parallel lift arms, each lift arm having a first end with a pilot bearing thereon for supporting the roll, each lift arm having a second end operably associated with the lift arm track, the lift arms being horizontally movable relative to each other along the lift arm track, whereby the lift arms move away from each other to accept the roll and toward each other to releasably and rotatably hold the roll between the pilot bearings;

a guide cam located around the turret shaft and having an outer rim for supporting the lift arm assembly while the lift arm assembly moves between the first position and the second position;

a support beam extending from the lift arm track toward the guide cam, the support beam having a distal end;

a cam yoke roller at the distal end of the support beam, the cam yoke roller cooperating with the outer rim to support the lift arm assembly during its movement around the turret shaft and including a block defining a groove therein, the cam yoke roller being slidably mounted on the outer rim of the guide cam with the outer rim positioned within the groove when the lift arm assembly is in the up position;

a lifting mechanism associated with the cam yoke roller for pivoting the lift arm assembly by moving the cam yoke roller;

the outer rim of the guide cam defining a curvature and the guide cam defining a cutout at the outer rim corresponding to one of the first and second positions;

the lifting mechanism including a lift truck having a front end and a back end, a lifting cylinder connected to the back end of the lift truck for moving the lift truck between an engaged position and a disengaged position, a guide track operably associated with the lift truck for guiding the lift truck as the lift truck moves between the engaged and disengaged positions, a cam section extending from the front end of the lift truck, the cam section configured to engage the guide cam by fitting within the cutout when the lift truck is in the engaged position, the cam section further having an outer edge with a curvature such that the curvature of the outer rim of the guide cam is continued along the outer edge of the cam section; and wherein when the lift arm assembly moves to one of the first and second positions, the cam section is positioned within the groove of the cam yoke roller, whereby the cam yoke roller moves together with the lift truck to pivot the lift arm assembly between the up and down positions.

9. The machine of claim 8 further comprising a drive tower extending upwardly from the turret shaft for turning the roll to unwind material therefrom;

the drive tower including a tower frame, a turning belt, a drive for rotating the turning belt; a belt frame, a belt frame axle, an upper roller, and a lower roller;

the tower frame having a generally vertical first side wall, a generally vertical second side wall, an upper portion, and a lower portion, the lower portion including a bracket extending between the first and second side walls and mounted to the turret shaft, the belt frame axle extending through the first and second side walls of the tower frame adjacent to the upper portion;

the belt frame including a first member, a second member, a free end, and an axle end, the first and second members being located between the first and second side walls of the tower frame, the axle end of the belt frame pivotally attached to the belt frame axle and the free end of the belt frame being adjacent to the lower portion of the tower frame;

the upper roller and the lower roller being disposed between the first and second members of the belt frame; the upper roller being coaxial with the belt frame axle, and the lower roller being adjacent to the free end of the belt frame; and the turning belt extending around the upper and lower rollers and having a contact surface for frictionally contacting the roll and driving the roll, the belt frame being pivoted at the belt frame axle such that the free end of the belt frame extends outwardly from the tower frame and toward the roll being held by the lift arm assembly, whereby when the turning belt contacts the roll, the roll is turned to unwind material therefrom.

10. A machine for moving a roll of material from a first position to a second position and for turning the roll to unwind material therefrom, the machine comprising:

a generally horizontal base;

a turret shaft extending upwardly from the base;

a turret bearing ring coaxially and rotatably disposed around the turret shaft;

a lift arm assembly connected to the turret bearing ring and movable around the turret shaft between a first position and a second position in conjunction with the turret bearing ring;

the lift arm assembly including a lift arm track connected to the turret bearing ring;

the lift arm assembly further including two generally parallel lift arms, each lift arm having a first end with a pilot bearing thereon for supporting the roll, each lift arm having a second end operably associated with the lift arm track, the lift arms being adapted to be horizontally movable relative to each other along the lift arm track, whereby the lift arms move away from each other to accept the roll and toward each other to releasably and rotatably hold the roll between the pilot bearings;

a guide cam located around the turret shaft and having an outer rim for supporting the lift arm assembly while the lift arm assembly moves between the first position and the second position;

a support beam extending from the lift arm track toward the guide cam, the support beam having a distal end;

a cam yoke roller at the distal end of the support beam, the cam yoke roller cooperating with the outer rim to support the lift arm assembly during its rotation around the turret shaft;

a drive tower extending upwardly from the turret shaft for turning the roll to unwind material therefrom; the drive tower including a tower frame, a turning belt, a drive for rotating the turning belt, a belt frame, a belt frame axle, an upper roller, and a lower roller;

the tower frame having a generally vertical first side wall, a generally vertical second side wall, an upper portion, and a lower portion, the lower portion including a bracket extending between the first and second side walls and mounted to the turret shaft, the belt frame axle extending through the first and second side walls of the tower frame adjacent to the upper portion;

the belt frame including a first member, a second member, a free end, and an axle end, the first and second members being located between the first and second side walls of the tower frame, the axle end of the belt frame pivotally attached to the belt frame axle, and the free end of the belt frame being adjacent to the lower portion of the tower frame;

the upper roller and the lower roller being disposed between the first and second members of the belt frame, the upper roller being coaxial with the belt frame axle, and the lower roller being adjacent to the free end of the belt frame; and the turning belt extending around the upper and lower rollers and having a contact surface for frictionally contacting the roll and driving the roll, the belt frame being pivoted at the belt frame axle such that the free end of the belt frame extends outwardly from the tower frame and toward the roll being held by the lift arm assembly, whereby when the turning belt contacts the roll, the roll is turned to unwind material therefrom.

11. The machine of claim 10 wherein the lift arm assembly is pivotally connected to the turret bearing ring and is pivotable between an up position and a down position.

12. The machine of claim 10 wherein the cam yoke roller comprises a block defining a groove therein, the cam yoke roller being slidably mounted on the outer rim of the guide cam with the outer rim positioned within the groove when the lift arm assembly is in the up position.

13. The machine of claim 12 further comprising a lifting mechanism associated with the cam yoke roller for pivoting the lift arm assembly by moving the cam yoke roller;

the outer rim of the guide cam defining a curvature, and the guide cam defining a cutout at the outer rim of the guide cam corresponding to one of the first and second positions;

the lifting mechanism including a lift truck having a front end and a back end, a lifting cylinder connected to the back end of the lift truck for moving the lift truck between an engaged position and a disengaged position, a guide track operably associated with the lift truck for guiding the lift truck as the lift truck moves between the engaged and disengaged positions, a cam section extending from the front end of the lift truck, the cam section configured to engage the guide cam by fitting within the cutout when the lift truck is in the engaged position, the cam section further having an outer edge with a curvature such that the curvature of the outer rim of the guide cam is continued along the outer edge of the cam section; and wherein when the lift arm assembly rotates to one of the first and second positions, the cam section is positioned within the groove of the cam yoke roller, whereby the cam yoke roller moves together with the lift truck to pivot the lift arm assembly between the up and down positions.

14. The machine of claim 13 wherein the free end of the belt frame pivots outwardly toward the roll when the lift arm assembly is holding a roll and is in the up position.

* * * * *